US009818506B2

(12) United States Patent
Andrews et al.

(10) Patent No.: US 9,818,506 B2
(45) Date of Patent: Nov. 14, 2017

(54) FLEXIBLE LOW IMPEDANCE POWER BUS

(71) Applicant: The Boeing Company, Chicago, IL (US)

(72) Inventors: Eric J. Andrews, Orange, CA (US); Timothy R. Bristol, Orange, CA (US); Eddie L. Lyons, Orange, CA (US); Loren Owen Criss, Orange, CA (US)

(73) Assignee: The Boeing Company, Chicago, IL (US)

( * ) Notice: Subject to any disclaimer, the term of this patent is extended or adjusted under 35 U.S.C. 154(b) by 466 days.

(21) Appl. No.: 14/260,571

(22) Filed: Apr. 24, 2014

(65) Prior Publication Data

US 2015/0311586 A1 Oct. 29, 2015

(51) Int. Cl.

| | |
|---|---|
| ***H01B 13/06*** | (2006.01) |
| ***H01R 12/59*** | (2011.01) |
| ***H01R 12/65*** | (2011.01) |
| ***H01R 31/02*** | (2006.01) |
| *H01Q 1/28* | (2006.01) |
| *H01B 7/00* | (2006.01) |

(52) U.S. Cl.

CPC ..... *H01B 13/06* (2013.01); *H01R 12/592* (2013.01); *H01R 12/65* (2013.01); *H01R 31/02* (2013.01); *H01B 7/0018* (2013.01); *H01Q 1/28* (2013.01); *H01R 2201/02* (2013.01)

(58) Field of Classification Search

CPC ..... H01Q 1/50; H01B 7/04; H01R 12/7076

See application file for complete search history.

(56) References Cited

U.S. PATENT DOCUMENTS

| | | | | |
|---|---|---|---|---|
| 6,898,354 | B2 * | 5/2005 | Kim | G02B 6/4483 385/100 |
| 7,595,759 | B2 * | 9/2009 | Schlub | H01Q 1/243 343/700 MS |
| 2004/0238194 | A1 * | 12/2004 | Barr | H05K 1/0216 174/33 |

* cited by examiner

*Primary Examiner* — Graham Smith
*Assistant Examiner* — Noel Maldonado
(74) *Attorney, Agent, or Firm* — Kwan & Olynick LLP

(57) ABSTRACT

Systems, methods, and apparatus are disclosed for implementing power buses. Apparatus may include a first plurality of connectors, a second plurality of connectors, and a first plurality of conductive sheets configured to electrically couple the first plurality of connectors with the second plurality of connectors. The first plurality of conductive sheets may include a first conductive sheet and a second conductive sheet. The first conductive sheet may conduct a first current in a first direction. The second conductive sheet may provide a return path for the first current in a second direction. The apparatus may also include a second plurality of conductive sheets. The second plurality of conductive sheets may include a third conductive sheet and a fourth conductive sheet. The third conductive sheet may conduct a second current in the first direction. The fourth conductive sheet may provide a return path for the second current in the second direction.

20 Claims, 7 Drawing Sheets

FLEXIBLE LOW IMPEDANCE POWER BUS

TECHNICAL FIELD

This disclosure generally relates to vehicles and machinery and, more specifically, to power buses that may be used with such vehicles and machinery.

BACKGROUND

Various vehicles, such as aircraft, may include radar arrays. For example, a vehicle may include an active electronically scanned array (AESA) that includes an antenna which may be coupled to a power source that provides power to the antenna. In operation, the power source may switch on and off at a high frequency using field-effect transistors. The pulsed power signal may be provided to the antenna and used to power the antenna when the antenna is used to transmit a signal. Conventional wires and cables that may be used to couple the power source with the antenna remain limited because they cannot cleanly and efficiently provide power from the power source to the antenna.

SUMMARY

Provided are systems, methods, and apparatus for implementing a power bus. In some embodiments, apparatus disclosed herein may include a first plurality of connectors and a second plurality of connectors. The apparatus may also include a first plurality of conductive sheets configured to electrically couple the first plurality of connectors with the second plurality of connectors. The first plurality of conductive sheets may include a first conductive sheet and a second conductive sheet. The first conductive sheet may be configured to conduct a first current in a first direction. The second conductive sheet may be configured to provide a return path for the first current in a second direction. The apparatus may also include a second plurality of conductive sheets configured to electrically couple the first plurality of connectors with the second plurality of connectors. The second plurality of conductive sheets may include a third conductive sheet and a fourth conductive sheet. The third conductive sheet may be configured to conduct a second current in the first direction. The fourth conductive sheet may be configured to provide a return path for the second current in the second direction.

In some embodiments, the apparatus may also include a third plurality of conductive sheets configured to electrically couple the first plurality of connectors with the second plurality of connectors. The third plurality of conductive sheets may include a fifth conductive sheet and a sixth conductive sheet. The fifth conductive sheet may be configured to conduct a third current in the first direction. The sixth conductive sheet may be configured to provide a return path for the third current in the second direction. The apparatus may also include a fourth plurality of conductive sheets configured to electrically couple the first plurality of connectors with the second plurality of connectors. The fourth plurality of conductive sheets may include a seventh conductive sheet and an eighth conductive sheet. The seventh conductive sheet may be configured to conduct a fourth current in the first direction. The eighth conductive sheet may be configured to provide a return path for the fourth current in the second direction.

According to some embodiments, each of the first conductive sheet, the second conductive sheet, the third conductive sheet, and the fourth conductive sheet has a length and a width, wherein the width is about half of the length. Moreover, the first plurality of conductive sheets may be disposed between a first cover layer and a second cover layer, and the second plurality of conductive sheets may be disposed between a third cover layer and a fourth cover layer. In some embodiments, each of the first cover layer, the second cover layer, the third cover layer, and the fourth cover layer are flexible. According to some embodiments, a first distance between the first conductive sheet and the second conductive sheet may be less than about 0.007 inches. Moreover, a second distance between the third conductive sheet and the fourth conductive sheet may be less than about 0.007 inches.

In some embodiments, the first conductive sheet, the second conductive sheet, the third conductive sheet, and the fourth conductive sheet each have a thickness that is less than about 0.005 inches. Moreover, the first plurality of conductive sheets may include a first insulating layer between the first conductive sheet and the second conductive sheet, and the second plurality of conductive sheets may include a second insulating layer between the third conductive sheet and the fourth conductive sheet. In some embodiments, the first insulating layer includes a first polyimide film, and the second insulating layer includes a second polyimide film.

In various embodiments, the first plurality of connectors is coupled to a first circuit board, and the second plurality of connectors is coupled to a second circuit board. In some embodiments, a first end of the first plurality of conductive sheets may be coupled to the first circuit board, a second end of the first plurality of conductive sheets may be coupled to the second circuit board, a first end of the second plurality of conductive sheets may be coupled to the first circuit board, and a second end of the second plurality of conductive sheets may be coupled to the second circuit board such that the first plurality of conductive sheets and the second plurality of conductive sheets may be coupled to the first circuit board and the second circuit board in parallel.

In some embodiments, the first plurality of connectors may be configured to be connected to a power source, and the second plurality of connectors may be configured to be connected to an antenna. Moreover, the first plurality of connectors and the second plurality of connectors each may include a material that includes one of gold, nickel, and copper.

Also disclosed herein are systems for transferring power. The systems may include a first plurality of connectors and a second plurality of connectors. The systems may also include a first plurality of conductive sheets configured to electrically couple the first plurality of connectors with the second plurality of connectors. The first plurality of conductive sheets may include a first conductive sheet and a second conductive sheet. The first conductive sheet may be configured to conduct a first current in a first direction. The second conductive sheet may be configured to provide a return path for the first current in a second direction. The systems may also include a second plurality of conductive sheets configured to electrically couple the first plurality of connectors with the second plurality of connectors. The second plurality of conductive sheets may include a third conductive sheet and a fourth conductive sheet. The third conductive sheet may be configured to conduct a second current in the first direction. The fourth conductive sheet may be configured to provide a return path for the second current in the second direction. The systems may further include a power source coupled to the first plurality of connectors. The power source may be configured to generate a power signal and may be further configured to provide the power signal to the first plurality of connectors. The systems may also include an antenna coupled to the second plurality of connectors. The antenna may be configured to receive the power signal from the second plurality of connectors.

In some embodiments, the first plurality of conductive sheets and the second plurality of conductive sheets may be configured to provide parallel conductive paths between the power source and the antenna. Furthermore, the systems may also include a third plurality of conductive sheets configured to electrically couple the first plurality of connectors with the second plurality of connectors. The third plurality of conductive sheets may include a fifth conductive sheet and a sixth conductive sheet. The fifth conductive sheet may be configured to conduct a third current in the first direction. The sixth conductive sheet may be configured to provide a return path for the third current in the second direction. The systems may also include a fourth plurality of conductive sheets configured to electrically couple the first plurality of connectors with the second plurality of connectors. The fourth plurality of conductive sheets may include a seventh conductive sheet and an eighth conductive sheet. The seventh conductive sheet may be configured to conduct a fourth current in the first direction. The eighth conductive sheet may be configured to provide a return path for the fourth current in the second direction. In some embodiments, the power signal has a voltage amplitude of about 12 V and a current amplitude of about 60 A. Moreover, the power signal generated by the power source may have a pulse repetition frequency of about 3 kHz to 300 kHz.

Further disclosed herein are methods for manufacturing a power bus. The methods may include providing a first plurality of conductive sheets. The first plurality of conductive sheets may include a first conductive sheet and a second conductive sheet. The methods may further include forming a first insulating layer between the first conductive sheet and the second conductive sheet. The methods may also provide a second plurality of conductive sheets. The second plurality of conductive sheets may include a third conductive sheet and a fourth conductive sheet. The methods may further include forming a second insulating layer between the third conductive sheet and the fourth conductive sheet, and coupling a first end of the first plurality of conductive sheets and a first end of the second plurality of conductive sheets with a first plurality of connectors. The methods may further include coupling a second end of the first plurality of conductive sheets and a second end of the second plurality of conductive sheets with a second plurality of connectors. The first plurality of conductive sheets and the second plurality of conductive sheets may be coupled in parallel.

In some embodiments, the methods further include providing a third plurality of conductive sheets. The third plurality of conductive sheets includes a fifth conductive sheet and a sixth conductive sheet. The methods may also include forming a third insulating layer between the fifth conductive sheet and the sixth conductive sheet and providing a fourth plurality of conductive sheets. The fourth plurality of conductive sheets may include a seventh conductive sheet and an eighth conductive sheet. The methods may further include forming a fourth insulating layer between the seventh conductive sheet and the eighth conductive sheet and coupling a first end of the third plurality of conductive sheets and a first end of the fourth plurality of conductive sheets with the first plurality of connectors. The methods may also include coupling a second end of the third plurality of conductive sheets and a second end of the fourth plurality of conductive sheets with the second plurality of connectors. The first plurality of conductive sheets, the second plurality of conductive sheets, the third plurality of conductive sheets, and the fourth plurality of conductive sheets may be coupled in parallel.

In some embodiments, the methods also include forming a first cover layer on a first surface of the first plurality of conductive sheets, forming a second cover layer on a second surface of the first plurality of conductive sheets, and forming a third cover layer on a first surface of the second plurality of conductive sheets. Moreover, the methods may also include forming a fourth cover layer on a second surface of the second plurality of conductive sheets. These and other features will be described in greater detail herein.

DETAILED DESCRIPTION

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific examples, it will be understood that these examples are not intended to be limiting.

As previously stated, a radar array, such as an active electronically scanned array (AESA), may be coupled to a power source that switches on and off at a very high rate to power the antenna. Conventional techniques for coupling the power source to the antenna may utilize cables or wires such as insulated wires and braided cables. However, such cables and wires result in poor performance characteristics of the antenna because they cannot cleanly and efficiently transfer power from the power source to the antenna. For example, the use of braided cables may result in high impedances at operational frequencies that result in the inefficient transfer of power. Furthermore, such conventional techniques typically have an unacceptably high inductance that prevents the circuit from achieving steady state quickly enough in relation to the pulse rate and rise time of the voltage pulse provided by the power source. This results in ringing or unwanted oscillation of the signal that is generated by the power source, and unacceptable performance characteristics of the radar array. Accordingly, conventional techniques are not able to satisfactorily couple the power source with the antenna at higher operational frequencies.

Various systems, methods, and apparatus are disclosed herein that provide a power bus to couple one or more components within a vehicle, such as a power source and an antenna. The power bus may include a conductive member that includes several conductive paths that are parallel to each other. The conductive paths may include sheets of a conductive material that have a geometry, a composition, and an arrangement relative to each other that are configured to transfer power and/or current from the power source to the antenna with minimal impedance while maintaining a high current capacity. Moreover, the power bus may also be configured to minimize its inductance, thus enabling the power bus to quickly transition from a zero voltage to a final pulse voltage, and further enabling the power bus to transfer the power signal with a high fidelity, thus maximizing performance characteristics of the antenna.

Figure 1:
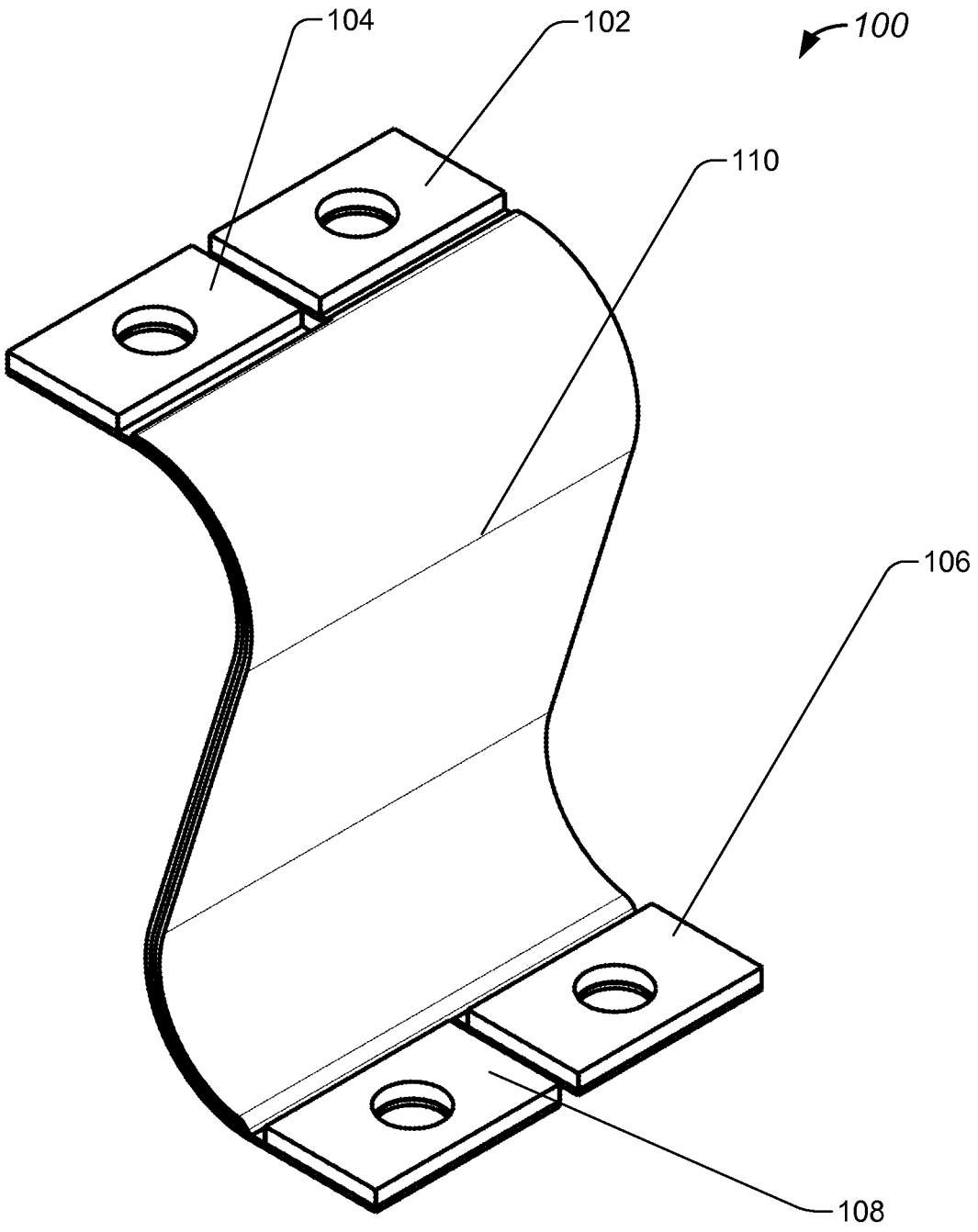
FIG. 1 illustrates an example of a power bus, implemented in accordance with some embodiments.

FIG. 1 illustrates an example of a power bus, implemented in accordance with some embodiments. In various embodiments, power bus 100 includes a first plurality of connectors and a second plurality of connectors which may be configured to be coupled or connected to one or more components of a vehicle, which may be an aircraft. For example, the first plurality of connectors may be connected to a power source which may be included in the aircraft and may be configured to generate a power signal that may be provided to various components included within the aircraft, such as an antenna. In some embodiments, the power source may switch and off rapidly. Thus, the generated power signal may have a pulse repetition frequency of between about 3 kHz and 300 kHz. Furthermore, the power signal may have an amplitude of about 12 V and may have a fast rise/set time of about 190 ns. The second plurality of connectors may be coupled or connected to an antenna, such as an antenna associated with an active electronically scanned array (AESA), which may be configured to transmit an output signal based, at least in part, on the received power signal. In this way, power bus 100 may be coupled to both the power source and the antenna, and may provide an electrical connection between the two.

In some embodiments, each of the pluralities of connectors may include multiple connectors which may be configured to be connected to or coupled to one or more terminals of the components within the aircraft, such as the power source and the antenna. For example, the first plurality of connectors may include first connector 102 and second connector 104 which may each include a contact pad. In some embodiments, first connector 102 may be configured to be coupled to a first terminal of the power source, which may be a supply terminal, and second connector 104 may be configured to be coupled to a second terminal of the power source, which may be a return terminal. Similarly, the second plurality of connectors may include third connector 106 and fourth connector 108. In some embodiments, third connector 106 may be configured to be coupled to a first terminal of the antenna and fourth connector 108 may be configured to be coupled to a second terminal of the antenna. In this way, the pluralities of connectors, as well as conductive member 110 discussed in greater detail below, may connect the first and second terminals of each of the power source and the antenna, and may provide a supply path and a return path for power or current generated by the power source and provided to the antenna.

In some embodiments, power bus 100 includes conductive member 110 which may include several conductors configured to transfer or conduct current between the first plurality of connectors and the second plurality of connectors. In some embodiments, the conductors included within conductive member 110 may be configured to have a low electrical impedance at operational frequencies and conditions associated with the power source and the antenna. Thus, the configuration of conductors included within conductive member 110 enables power bus 100 to supply power from the power source to the antenna at medium to high pulse repetition frequencies, which may range from about 3 kHz to 300 kHz, while maintaining a low impedance and inductance as well as a high current carrying capacity.

As discussed in greater detail below with reference to FIG. 3, FIG. 4A, and FIG. 4B, the conductors included within conductive member 110 may include one or more conductive sheets arranged as conductive pairs, or pairs of conductors or conductive sheets, which may be referred to herein interchangeably. In some embodiments, each pair of conductive sheets may include a first conductive sheet that is coupled to one of the first plurality of connectors, such as second connector 104, and one of the second plurality of connectors, such as fourth connector 108, such that the first sheet provides a supply path between the power source and the antenna. In this way, the first conductive sheet may be configured to transfer a current in a first direction. Moreover, each pair of conductive sheets may include a second sheet that is coupled to another connector of the first plurality of connectors, such as first connector 102, and another connector of the second plurality of connectors, such as third connector 106, to provide a return path between the power source and the antenna. In this way, the second conductive sheet may be configured to provide a return path for the current in a second direction. Accordingly, each pair of conductors may form a conductive path between the components coupled to the first plurality of connectors and the second plurality of connectors which may be, as previously discussed, a power source and antenna. In various embodiments, the pairs of conductors may be coupled to the first and second pluralities of connectors in parallel. Accordingly, conductive member 110 may include numerous parallel conductive paths formed by the different pairs of conductive sheets.

As similarly discussed above, the conductors included in conductive member 110 may be sheets of a conductive material that is highly conductive and has a low electrical resistance. For example, the conductive material may be a conductive metal, such as copper or gold. Moreover, the geometry of each conductive sheet as well as the arrangement of the conductive sheets within each conductive pair may be configured to minimize an impedance of conductive member 110 and maximize a current carrying capacity of conductive member 110. For example, a conductive sheet may be relatively wide, thus enabling the conduction of a large amount of current with minimal electrical resistance. In some embodiments, the width of the conductive sheet may be about half of the length of the conductive sheet. For example, a conductive sheet may be about two inches long and about 0.84 inches wide. Thus, each conductive sheet may be a relatively wide and flat sheet of conductive material. Moreover, each conductive sheet may be relatively thin. For example, a conductive sheet may have a thickness that is less than about 0.005 inches.

Furthermore, conductive sheets included in a conductive pair may be placed relatively close together to minimize inductance which may be generated during operation of power bus 100. In some embodiments, conductive sheets in a pair of conductors may be aligned, stacked on top of one another, and separated by a relatively small distance. For example, conductive sheets in a pair of conductors may be separated by a distance that is less than about 0.007 inches. In various embodiments, maintaining such a small distance between conductive sheets in the conductive pair, which form a supply path and a return path respectively, minimizes the amount of inductance within the conductive path formed by the conductive pair during operation of power bus 100. When configured in this way, an overall inductance of conductive member 110 may be less than about 10 nH. As discussed in greater detail below with reference to FIG. 2A, FIG. 2B, and FIG. 3, when multiple pairs of conductors are included in conductive member 110 and are coupled in parallel, an overall inductance of conductive member 110 may be reduced. For example, an inductance of conductive member 110 that is configured to include multiple pairs of conductors coupled in parallel may be less than 2 nH. In one example, an inductance of conductive member 110 may be about 1.4 nH.

In some embodiments, conductive sheets within a pair of conductors may be separated by an insulating layer which may include a dielectric material. For example, the dielectric material may be polyimide. Thus, the insulating layer may be a polyimide film. Moreover, the insulating layer may have a thickness of between about 0.002 inches and 0.007 inches. In this way, the insulating layer may provide physical and electrical separation between different conductive sheets within a pair of conductors included in conductive member 110. Furthermore, as discussed in greater detail below with reference to FIG. 3, each pair of conductors may be covered or encapsulated within one or more cover layers that cover and protect the conductive sheets included within each pair of conductors.

Figure 2A:
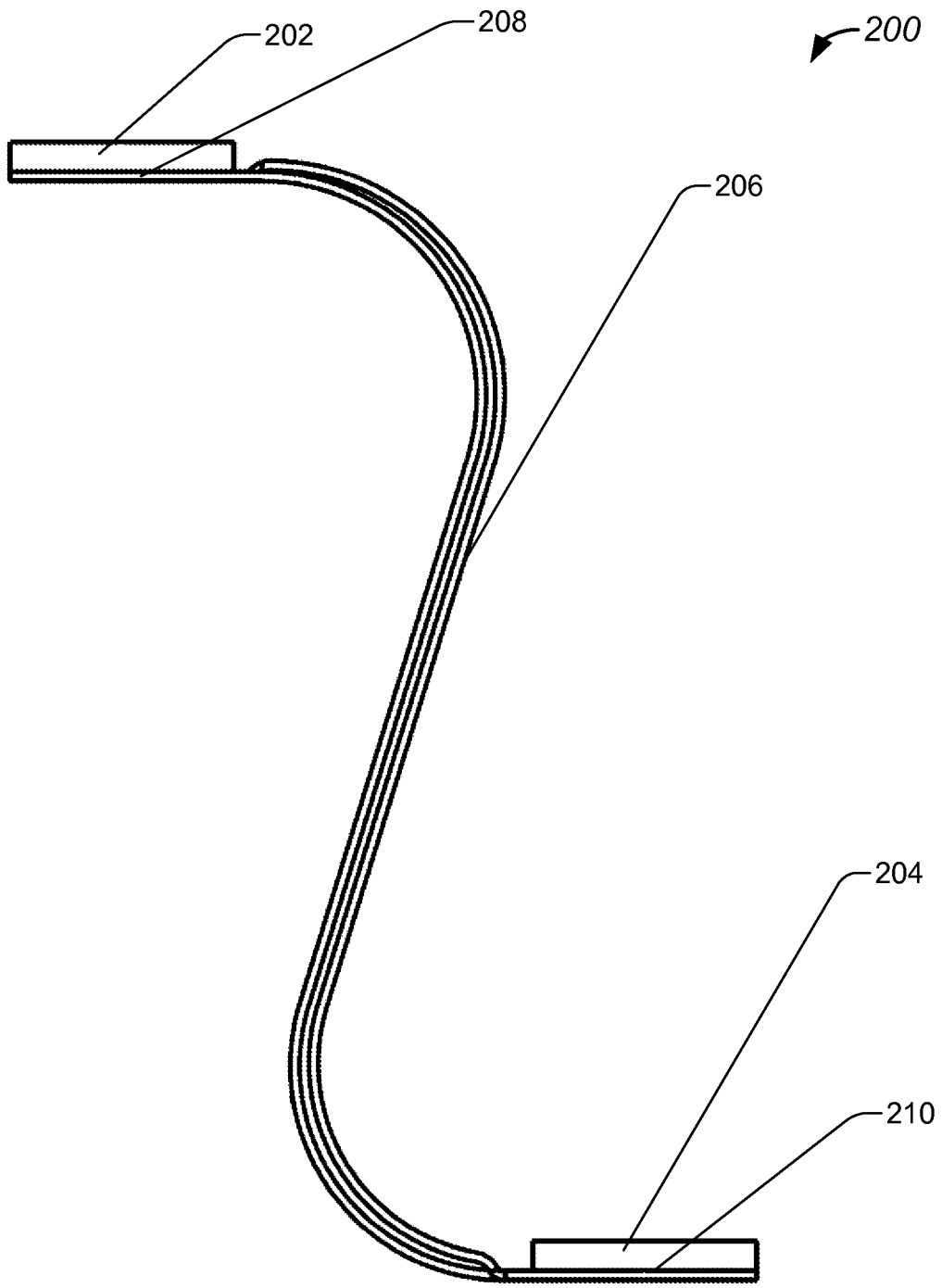
FIG. 2A illustrates a side view of an example of a power bus, implemented in accordance with some embodiments.
Figure 2B:
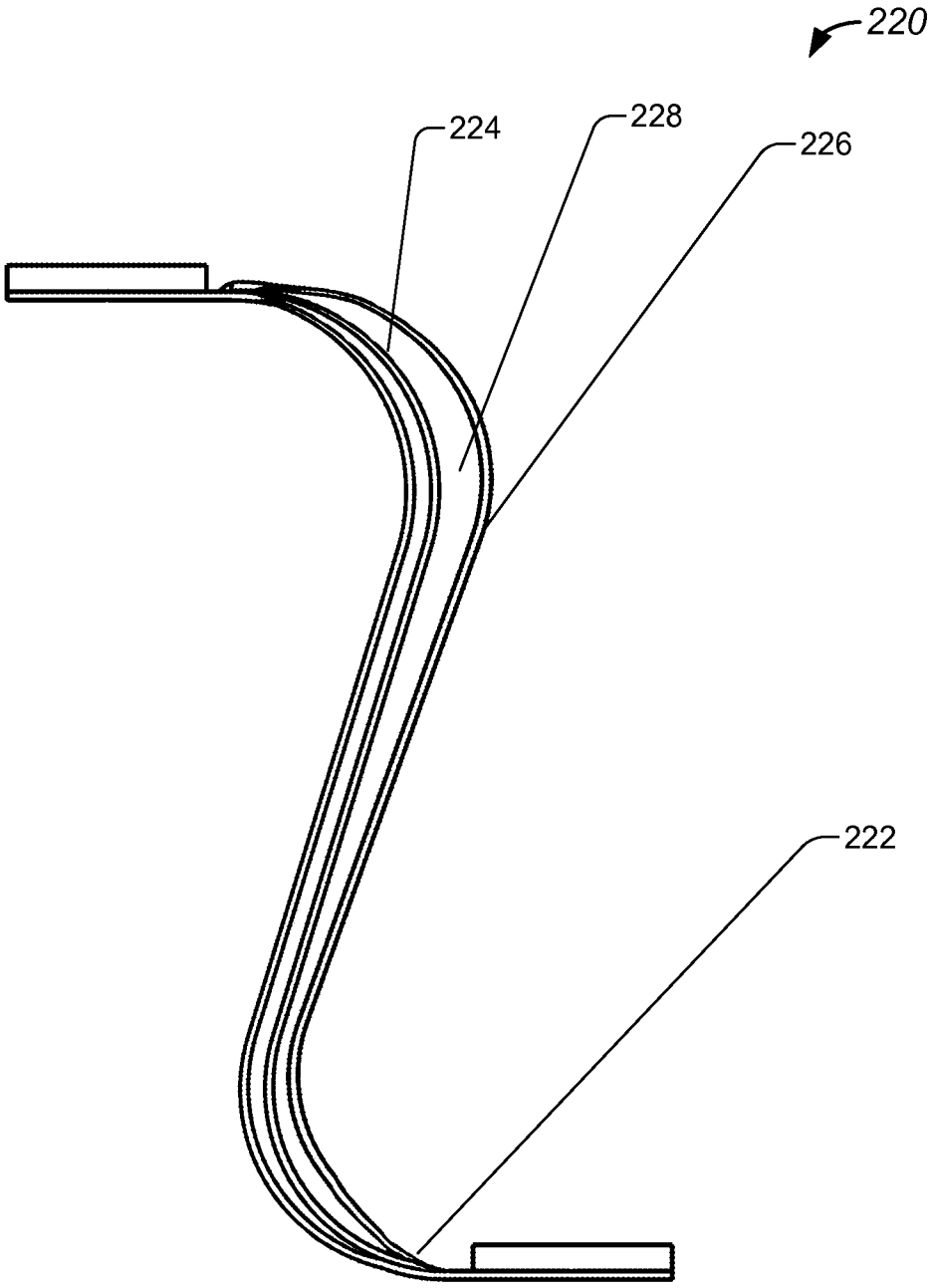
FIG. 2B illustrates another example of a power bus, implemented in accordance with some embodiments.

FIG. 2A illustrates a side view of an example of a power bus, implemented in accordance with some embodiments. As similarly discussed above with reference to FIG. 1, power bus 200 may include first plurality of connectors 202 and second plurality of connectors 204 which may be coupled to conductive member 206. As shown in FIG. 2, one or more portions of power bus 200 may be flexible. For example, conductive member 206 and the pairs of conductors included within conductive member 206 may be flexible in one or more directions, thus enabling the mechanical flexing of power bus 200, as discussed in greater detail below with reference to FIG. 2B. Such mechanical flexing may facilitate the coupling of power bus 200 with other components such as a power source and an antenna. Furthermore, the low impedance/inductance and high current carrying capacity characteristics of power bus 200 are maintained despite the application of such mechanical flexing to conductive member 206 and power bus 200.

In some embodiments, first plurality of connectors 202 and second plurality of connectors 204 may be coupled to conductive member 206 at rigid structural members, such as portion 208 and portion 210. Thus, portion 208 and portion 210 may provide rigid structural support for first plurality of connectors 202 and second plurality of connectors 204. Portion 208 and portion 210 may further provide a rigid point of attachment between the pluralities of connectors and pairs of conductors included within conductive member 206. As discussed in greater detail below with reference to FIG. 3, portion 208 and portion 210 may each include structural members, such as circuit boards, which may facilitate the coupling of each conductive sheet included in conductive member 206 with first plurality of connectors 202 and second plurality of connectors 204.

FIG. 2B illustrates another example of a power bus, implemented in accordance with some embodiments. As similarly discussed above with reference to FIG. 1 and FIG. 2A, a power bus, such as power bus 220, may include a conductive member, such as conductive member 222. As shown in FIG. 2B, power bus 220 and conductive member 222 are mechanically flexed. Each pair of conductors included in conductive member 222 is disposed between a first cover layer and a second cover layer. Thus, each pair of conductors is enclosed in material that is used to form the first cover layer and the second cover layer. In some embodiments, each pair of conductors is independently flexible. As shown in FIG. 2B, first pair of conductive sheets 224 is flexed independently of second pair of conductive sheets 226 and may be separated from second pair of conductive sheets 226 by space 228 when in a flexed position. The independent flexibility of the pairs of conductors may further facilitate the flexing of conductive member 222 and the coupling of power bus 220 to one or more components included in a vehicle. Furthermore, in some embodiments, a material included in the cover layers may be configured to have a small frictional coefficient that minimizes a shear resistance between conductive pairs that may be present when flexing occurs. In some embodiments, the cover layers may be coated with another material which is configured to have a small frictional coefficient that may minimize the shear resistance between conductive pairs. Thus, conductive pairs may be coated or treated with another material to minimize shear resistance and facilitate flexing of power bus 220.

Figure 3:
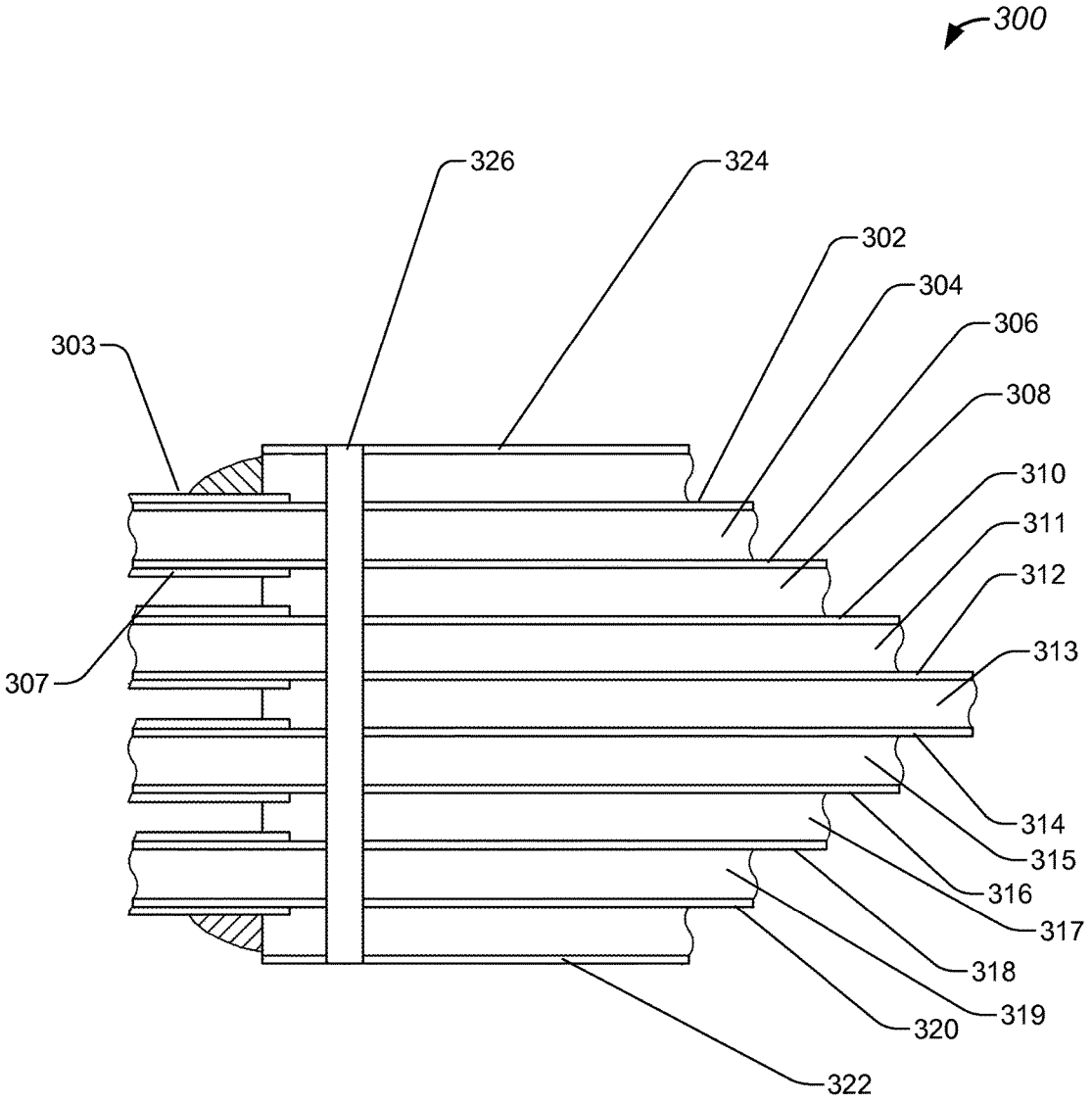
FIG. 3 illustrates a cross-sectional view of an end of a power bus, implemented in accordance with some embodiments.

FIG. 3 illustrates a cross-sectional view of an end of a power bus, implemented in accordance with some embodiments. As similarly discussed above, a conductive member which may be included in power bus 300 may include several conductive sheets of a conductive material that are arranged as pairs of conductors. Each pair of conductors may be configured to provide a supply path and a return path between connectors associated with power bus 300. In various embodiments, the ends of the conductive member may include or be coupled to rigid support members which provide one or more structural components to facilitate the mechanical and electrical coupling of the conductive sheets with the connectors. In some embodiments, the rigid support members may be circuit boards configured to couple the pairs of conductive sheets in parallel.

Accordingly, power bus 300 may include a first conductive pair that includes first conductive sheet 302 and second conductive sheet 306. In some embodiments, first conductive sheet 302 and second conductive sheet 306 may be separated by first insulating layer 304 which may include a dielectric material. Furthermore, first conductive sheet 302 and second conductive sheet 306 may be enclosed within a cover or protective material that may include, at least in part, cover layer 303 and cover layer 307. While FIG. 3 illustrates cover layer 303 and cover layer 307 as covering a portion of first conductive sheet 302 and second conductive sheet 306, respectively, cover layer 303 and cover layer 307 may extend along the entire length of first conductive sheet 302 and second conductive sheet 306, as shown and discussed above with reference to FIG. 1, FIG. 2A, and FIG. 2B.

Power bus 300 may further include a second conductive pair that includes third conductive sheet 310 and fourth conductive sheet 312 which may be separated by second insulating layer 311. In some embodiments, the first conductive pair and the second conductive pair may be separated by first spacer layer 308 which may be a portion of a rigid structural member, such as a circuit board. Thus, the rigid structural member may include spacing layers that are formed or disposed between conductive pairs at ends of a conductive member where the conductive member may be coupled or connected to one or more connectors.

Power bus 300 may also include a third conductive pair that includes fifth conductive sheet 314 and sixth conductive sheet 316 which may be separated by third insulating layer 315 which may include a dielectric material such as polyimide. As similarly discussed above, the third conductive pair may be separated from the second conductive pair by second spacer layer 313. Further still, power bus 300 may additionally include a fourth conductive pair that includes seventh conductive sheet 318 and eighth conductive sheet 320 which may be separated by fourth insulating layer 319. The fourth conductive pair may be separated from the third conductive pair by fourth spacer layer 317.

Accordingly, as shown in FIG. 3, power bus 300 includes four conductive pairs of conductive sheets. Each conductive pair provides a conductive path between connectors which may be coupled to different ends of the conductive member. When a power source is coupled to a first end of the conductive member and an antenna is coupled to a second end of the conductive member, each conductive pair may provide a supply path and a return path to and from the antenna. As similarly discussed above, the conductive pairs, and their associated conductive paths, may be coupled in parallel. In various embodiments, coupling the pairs of conductive sheets in parallel further reduces the impedance of the conductive member by reducing its electrical resistance. For example, the overall resistance of the conductive member may be less than 120 milliohms. Moreover, coupling the pairs of conductive sheets in parallel further increases the current carrying capacity of the conductive member and power bus 300, which may carry or conduct a current in excess of 60 A.

In various embodiments, power bus 300 may include one or more contact pads to facilitate electrical coupling between the conductive pairs and external components that are coupled to power bus 300. For example, power bus 300 may include first contact pad 322 and second contact pad 324. In various embodiments, the connectors included in power bus 300 and/or their associated components, such as first contact pad 322 and second contact pad 324, may include a conductive material. For example, they may include a conductive metal such at gold, nickel, copper, or any of their alloys. In various embodiments, the size of the connectors and their associated components, which may include first contact pad 322 and second contact pad 324, may be configured based on one or more operational parameters associated with power bus 300. For example, for high current applications that use power signals having high current amplitudes, such as about 60 A, a larger sized contact pad may be implemented. In this way, the size of the contact pads, as well as other components associated with the connectors, may be increased to achieve a higher current carrying capacity for power bus 300.

In various embodiments, power bus 300 may also include a through-hole, such as hole 326. In some embodiments, hole 326 may extend through the entirety of power bus 300 and may be configured to receive a fastening device, such as a screw. In some embodiments, an interior surface of hole 326 may be coated or plated with a conductive material, which may be a metal, and may be mechanically or structurally configured to receive the fastening device. For example, the interior surface may be threaded. In this way, an interior surface of hole 326 may provide mechanical and electrical coupling with the fastening device. In some embodiments, the fastening device may also be fastened to a component, such as a terminal of a power source or an antenna. Thus, hole 326 may provide mechanical and electrical coupling with the component via the fastening device. While FIG. 3 illustrates one hole, in some embodiments, power bus 300 may include multiple holes in the rigid portion at each end of the conductive member. In some embodiments, the multiple holes may be operable as vias that provide additional electrical coupling within the connectors, thus further decreasing the overall electrical resistance of power bus 300.

Figure 4A:
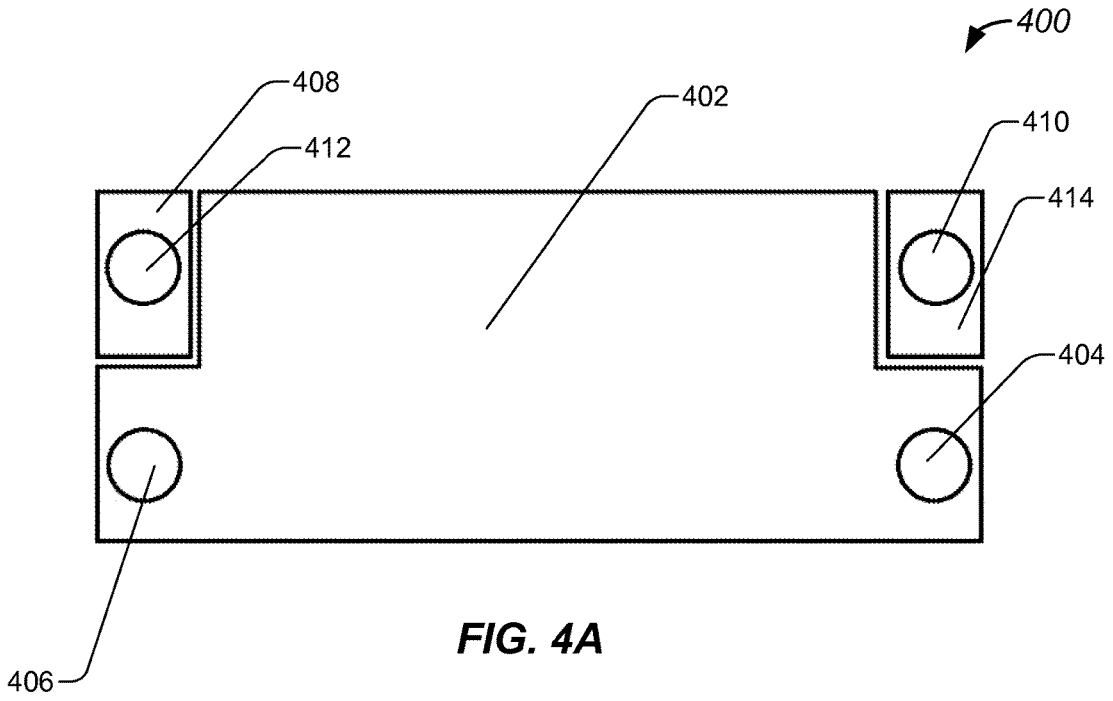
FIG. 4A illustrates an example of a layer of a power bus, implemented in accordance with some embodiments.

FIG. 4A illustrates an example of a layer of a power bus, implemented in accordance with some embodiments. In various embodiments, layer 400 is a first layer of a conductive member that includes a first pair of conductive sheets. Accordingly, the first pair of conductive sheets may include first conductive sheet 402. As shown in FIG. 4A, first conductive sheet 402 is a relatively wide sheet of a conductive material, such as copper. Furthermore, hole 406, which may be associated with a first plurality of connectors at a first end of the conductive member, may extend through first conductive sheet 402. Similarly, hole 404, which may be associated with a second plurality of connectors at a second end of the conductive member, may also extend through first conductive sheet 402. Thus, first conductive sheet 402 may contact or be coupled to an internal surface of hole 406 and hole 404 and/or one or more fastening devices that may be inserted into hole 406 and/or hole 404. When coupled in this way, first conductive sheet 402 may provide a conductive path between hole 406 and hole 404 as well as their associated contact pads/connectors. For example, first conductive sheet 402 may be configured to provide a supply path that transfers a current in a first direction between a power source coupled to hole 406 and an antenna coupled to hole 404.

As shown in FIG. 4A, first conductive sheet 402 does not extend to hole 412 and hole 410 and is not directly electrically coupled to hole 412 and hole 410 or their associated contact pads/connectors. Layer 400 may also include conductive portion 408 and conductive portion 414 which may be coupled or bonded to an underlying layer, such as layer 420 discussed in greater detail below. Accordingly, conductive portion 408 and conductive portion 414 may be configured to provide extensions of layer 420 that provide structural support within the layered design of the power bus that includes layer 400 and layer 420.

Figure 4B:
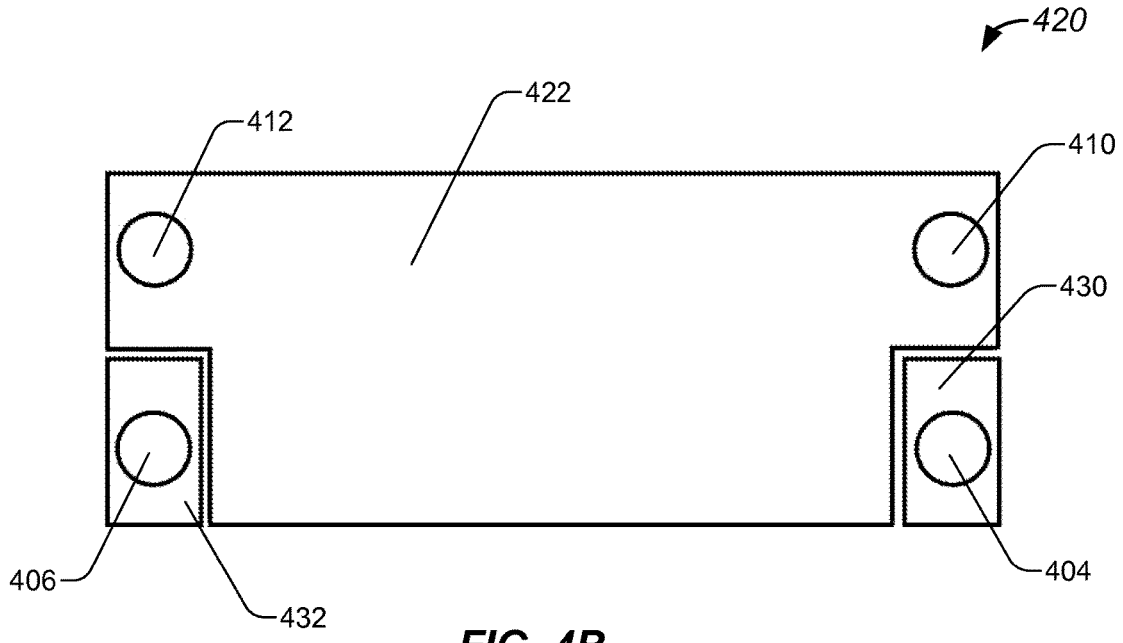
FIG. 4B illustrates an example of another layer of a power bus, implemented in accordance with some embodiments.

FIG. 4B illustrates an example of another layer of a power bus, implemented in accordance with some embodiments. According to various embodiments, layer 420 is a second layer that is formed or disposed below or underneath layer 400 discussed above with reference to FIG. 4A. Layer 420 may include a second conductive sheet, such as second conductive sheet 422, that is included in the first pair of conductive sheets. As similarly discussed previously, an insulating layer may be formed or disposed between first conductive sheet 402 and second conductive sheet 422 to mitigate electrical coupling between the two conductive sheets within the conductive member.

In some embodiments, hole 412 and hole 410 both extend through second conductive sheet 422. Thus, second conductive sheet 422 may contact or be coupled to an internal surface of hole 412 and hole 410 and/or one or more fastening devices that may be inserted into hole 412 and hole 410. When coupled in this way, second conductive sheet 422 may provide a conductive path between hole 412 and hole 410 as well as their associated contact pads/connectors. For example, second conductive sheet 422 may be configured to provide a return path that transfers a current in a second direction between an antenna coupled to hole 410 and a power source coupled to hole 412.

In some embodiments, second conductive sheet 422 does not extend to hole 406 and hole 404 and is not directly electrically coupled to hole 406 and hole 404 or their associated contact pads/connectors. Accordingly, first conductive sheet 402 may provide a first conductive path between hole 404 and hole 406, as well as contact pads associated with each hole and terminals of external components which may be coupled to each of the contact pads, hole 404, and hole 406. Similarly, second conductive sheet 422 may provide a second conductive path between hole 410 and hole 412, as well as contact pads associated with each hole and terminals of external components which may be coupled to each of the contact pads, hole 410, and hole 412. For example, first conductive sheet 402 may provide a first conductive path between a first terminal of a power source and a first terminal of an antenna. Moreover, second conductive sheet 422 may provide a second conductive path between a second terminal of the power source and a second terminal of the antenna.

Furthermore, layer 420 may also include conductive portion 430 and conductive portion 432 which may be coupled or bonded to another layer, such as layer 400. Accordingly, conductive portion 430 and conductive portion 432 may be configured to provide extensions of layer 400 that provide structural support within the layered design of the power bus that includes layer 400 and layer 420.

Figure 5:
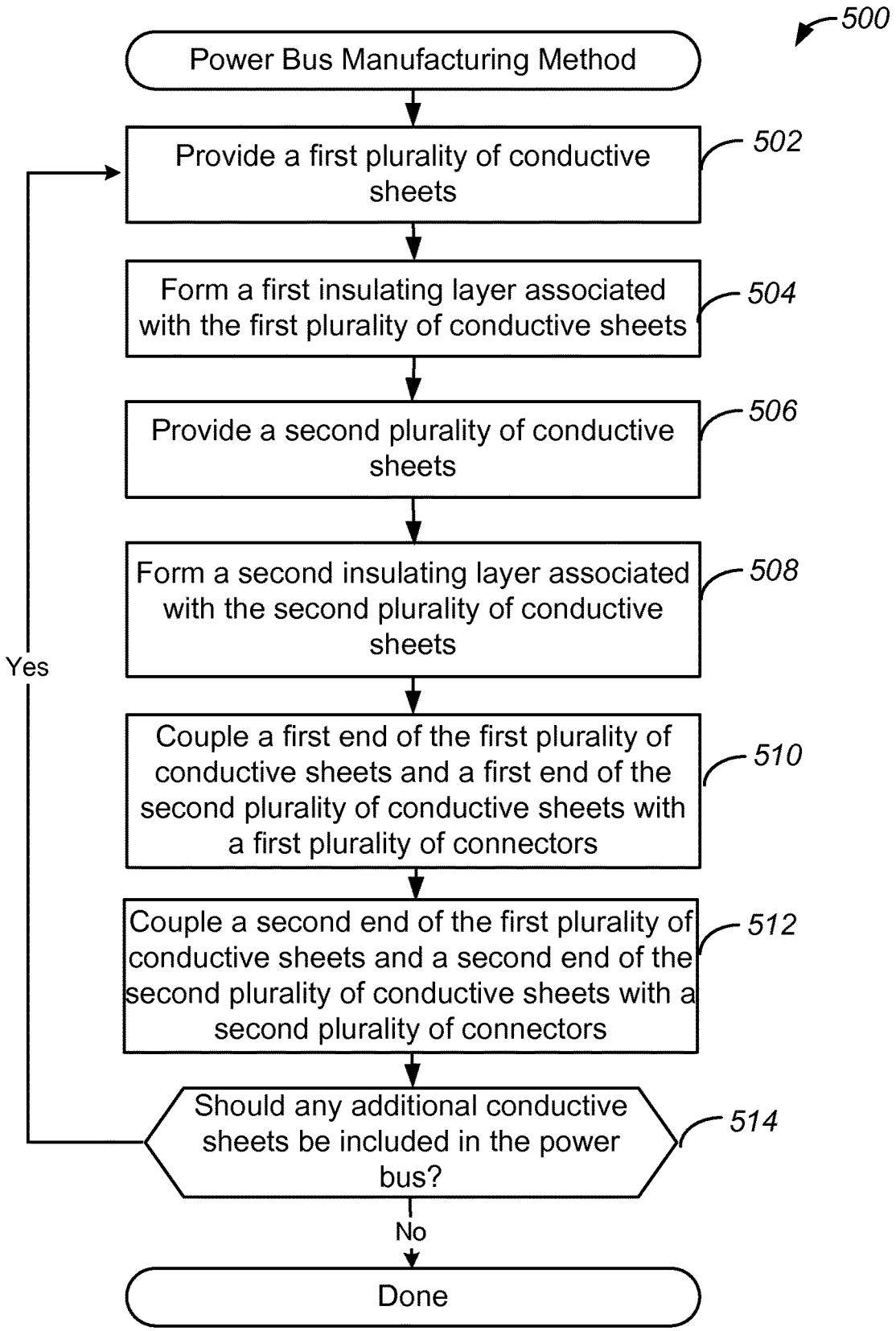
FIG. 5 illustrates an example of a method for manufacturing a power bus, implemented in accordance with some embodiments.

FIG. 5 illustrates an example of a method for manufacturing a power bus, implemented in accordance with some embodiments. Accordingly, a power bus manufacturing method, such as method 500, may be implemented to manufacture a power bus that achieves low impedance/inductance characteristics as well as a high current carrying capacity while retaining a significant amount of mechanical flexibility. In some embodiments, a manufacturing process such as method 500 may be performed as part of an aircraft manufacturing method, as discussed in greater detail below with reference to FIG. 6. In various embodiments, method 500 may be performed separate from an aircraft manufacturing method and as part of an independent manufacturing process.

Accordingly, method 500 may commence with operation 502, during which a first plurality of conductive sheets may be provided. In various embodiments, the first plurality of conductive sheets may have been previously fabricated or may be stamped or cut out of a larger sheet. It will be appreciated that any suitable manufacturing process may be implemented to create the first plurality of conductive sheets. In one example, the first plurality of conductive sheets is a pair of conductive sheets that includes a first conductive sheet and a second conductive sheet. The first conductive sheet and the second conductive sheet may have a wide and thin geometry as described above with reference to FIG. 1, FIG. 4A and FIG. 4B.

During operation 504, a first insulating layer may be formed. As previously discussed, the first insulating layer may be a layer of a dielectric material that separates the first conductive sheet from the second conductive sheet. The insulating layer may be formed via any suitable deposition technique. For example, a film deposition technique may be implemented to create an insulating layer that includes a film of polyimide.

During operation 506, a second plurality of conductive sheets may be provided. As similarly discussed above with reference to operation 502, the second plurality of conductive sheets may have been previously fabricated or may be stamped or cut out of a larger sheet. The second plurality of conductive sheets may be a pair of conductive sheets that includes a third conductive sheet and a fourth conductive sheet. The third conductive sheet and the fourth conductive sheet may also have a wide and thin geometry as described above with reference to FIG. 1, FIG. 4A and FIG. 4B.

During operation 508, a second insulating layer may be formed. As similarly discussed above with reference to operation 504, the second insulating layer may include a dielectric material. Any suitable deposition technique may be used to form the second insulating layer. As similarly stated above, the same film deposition technique that was used during operation 504 may be used again to form a film of a dielectric material, such as polyimide. Alternatively, a different technique may be used with a different dielectric material to form a second insulating layer that has a composition that is different from the first insulating layer.

During operation 510, a first end of the first plurality of conductive sheets and a first end of the second plurality of conductive sheets may be coupled with a first plurality of connectors. For example, during operation 510 a first end of the first plurality of conductive sheets and a first end of the second plurality of conductive sheets may be coupled to a rigid support member which may facilitate coupling between the first plurality of connectors and the conductive sheets. In some embodiments, the rigid support member may include a first circuit board. Accordingly, during operation 510, one or more coupling or bonding operations may be performed to couple the first end of the first plurality of conductive sheets and the first end of the second plurality of conductive sheets to the first circuit board. Such coupling or bonding operations may include soldering or other flex circuit manufacturing processes.

During operation 512, a second end of the first plurality of conductive sheets and a second end of the second plurality of conductive sheets may be coupled with a second plurality of connectors. As similarly discussed above with reference to operation 510, a second end of the first plurality of conductive sheets and a second end of the second plurality of conductive sheets may be coupled to a rigid support member which may be a second circuit board. In this way, both ends of the first plurality of conductive sheets and the second plurality of conductive sheets may be coupled to rigid support members.

During operation 514, it may be determined whether or not any additional conductive sheets should be included in the power bus. If it is determined that no additional conductive sheets should be included in the power bus, then method 500 may terminate. If it is determined that additional conductive sheets should be included in the power bus, then method 500 may return to operation 502. Accordingly, additional pairs of conductive sheets may be added in subsequent iterations of method 500. For example, method 500 may return to operation 502, and a third plurality of conductive sheets and a fourth plurality of conductive sheets may be provided and coupled to the rigid support members. In this way, additional pairs of conductive sheets may be included within the power bus to create additional conductive paths within its conductive member.

Figure 6:
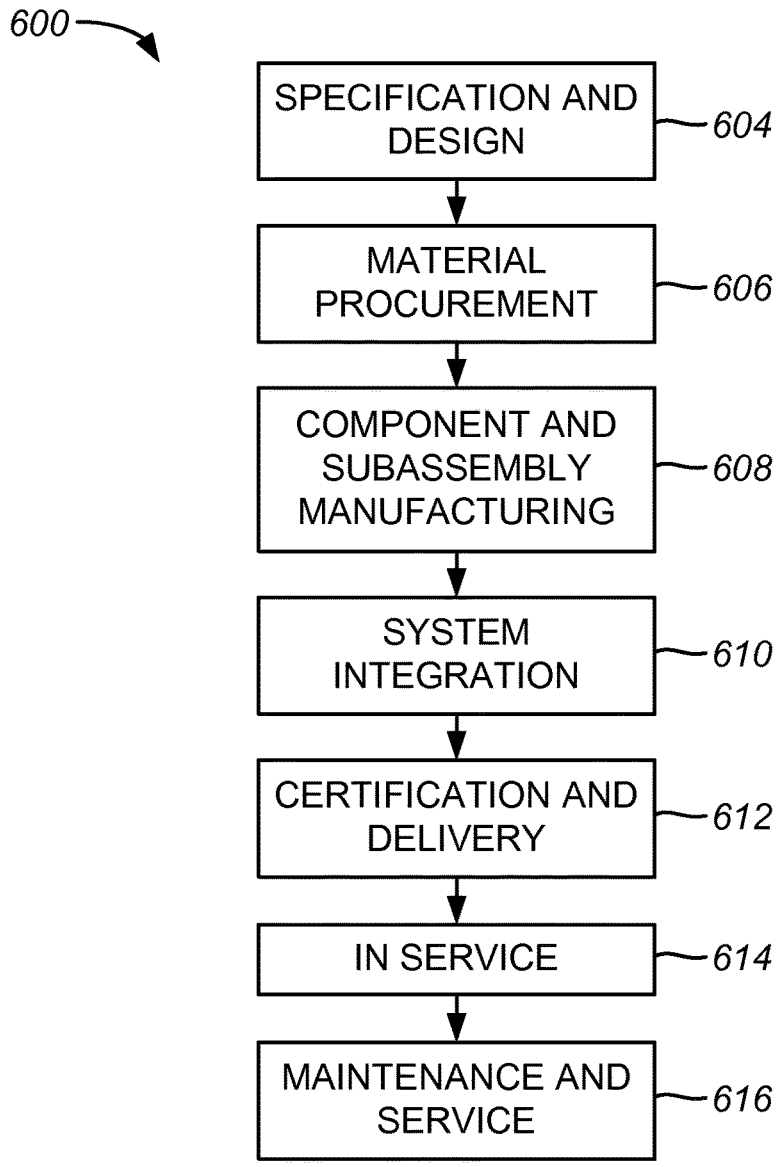
FIG. 6 illustrates a flow chart of an example of an aircraft production and service methodology, in accordance with some embodiments.
Figure 7:
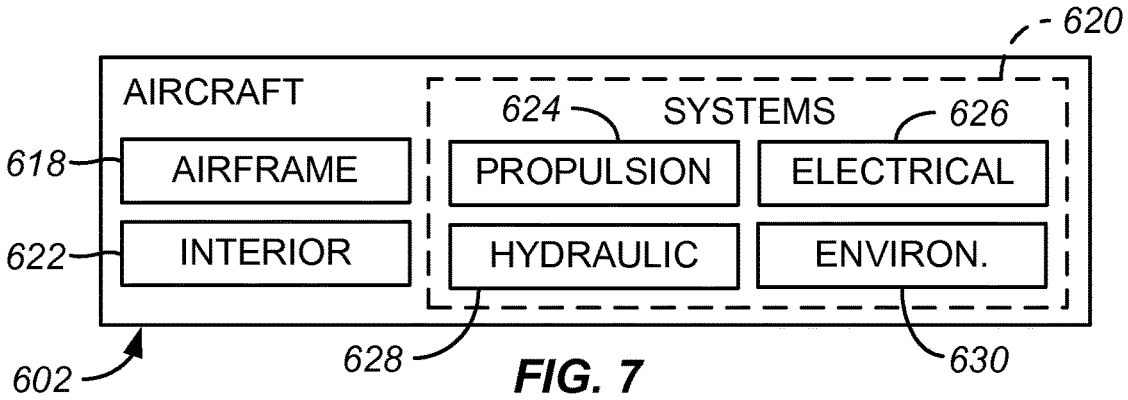
FIG. 7 illustrates a block diagram of an example of an aircraft, in accordance with some embodiments.

Various embodiments of the machining tools and methods described herein may be within the context of an aircraft manufacturing and service method 600 as shown in FIG. 6 and an aircraft 602 as shown in FIG. 7. During preproduction, illustrative method 600 may include specification and design 604 of the aircraft 602 and material procurement 606. During production, component and subassembly manufacturing 608 and system integration 610 of the aircraft 602 takes place. Thereafter, the aircraft 602 may go through certification and delivery 612 in order to be placed in service 614. While in service by a customer, the aircraft 602 is scheduled for routine maintenance and service 616 (which may also include modification, reconfiguration, refurbishment, and so on).

Each of the processes of method 600 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 7, the aircraft 602 produced by illustrative method 600 may include an airframe 618 with a plurality of systems 620 and an interior 622. Examples of high-level systems 620 include one or more of a propulsion system 624, an electrical system 626, a hydraulic system 628, and an environmental system 630. Any number of other systems may be included. Although an aerospace example is shown, the principles of the invention may be applied to other industries, such as the automotive industry.

Apparatus and methods embodied herein may be employed during any one or more of the stages of the production and service method 600. For example, components or subassemblies corresponding to production process 608 may be fabricated or manufactured in a manner similar to components or subassemblies produced while the aircraft 602 is in service. Also, one or more apparatus embodiments, method embodiments, or a combination thereof may be utilized during the production stages 608 and 610, for example, by substantially expediting assembly of or reducing the cost of an aircraft 602. Similarly, one or more of apparatus embodiments, method embodiments, or a combination thereof may be utilized while the aircraft 602 is in service, for example and without limitation, to maintenance and service 616.

Although the foregoing concepts have been described in some detail for purposes of clarity of understanding, it will be apparent that certain changes and modifications may be practiced within the scope of the appended claims. It should be noted that there are many alternative ways of implementing the processes, systems, and apparatus. Accordingly, the present examples are to be considered as illustrative and not restrictive.

What is claimed is:

1. An apparatus for transferring power, the apparatus comprising:

a first plurality of connectors;

a second plurality of connectors;

a first plurality of conductive sheets configured to electrically couple the first plurality of connectors with the second plurality of connectors, the first plurality of conductive sheets including a first conductive sheet and a second conductive sheet, wherein the first conductive sheet is configured to conduct a first current in a first direction, and wherein the second conductive sheet is configured to provide a return path for the first current in a second direction; and a second plurality of conductive sheets configured to electrically couple the first plurality of connectors with the second plurality of connectors, wherein the first plurality of conductive sheets and the second plurality of conductive sheets are independently flexible and independently encapsulated such that they are configured to provide independently flexible and encapsulated parallel conductive paths between the first and second plurality of connectors, the second plurality of conductive sheets including a third conductive sheet and a fourth conductive sheet, wherein the third conductive sheet is configured to conduct a second current in the first direction, and wherein the fourth conductive sheet is configured to provide a return path for the second current in the second direction.

2. The apparatus of claim 1 further comprising:

a third plurality of conductive sheets configured to electrically couple the first plurality of connectors with the second plurality of connectors, the third plurality of conductive sheets including a fifth conductive sheet and a sixth conductive sheet, wherein the fifth conductive sheet is configured to conduct a third current in the first direction, and wherein the sixth conductive sheet is configured to provide a return path for the third current in the second direction; and a fourth plurality of conductive sheets configured to electrically couple the first plurality of connectors with the second plurality of connectors, the fourth plurality of conductive sheets including a seventh conductive sheet and an eighth conductive sheet, wherein the seventh conductive sheet is configured to conduct a fourth current in the first direction, and wherein the eighth conductive sheet is configured to provide a return path for the fourth current in the second direction.

3. The apparatus of claim 1, wherein each of the first conductive sheet, the second conductive sheet, the third conductive sheet, and the fourth conductive sheet has a length and a width, wherein the width is about half of the length for each of the first conductive sheet, the second conductive sheet, the third conductive sheet, and the fourth conductive sheet.

4. The apparatus of claim 1, wherein the first plurality of conductive sheets is disposed between a first cover layer and a second cover layer, wherein the second plurality of conductive sheets is disposed between a third cover layer and a fourth cover layer, and wherein each of the first cover layer, the second cover layer, the third cover layer, and the fourth cover layer is flexible.

5. The apparatus of claim 1, wherein a first distance between the first conductive sheet and the second conductive sheet is less than about 0.007 inches, and wherein a second distance between the third conductive sheet and the fourth conductive sheet is less than about 0.007 inches.

6. The apparatus of claim 1, wherein the first conductive sheet, the second conductive sheet, the third conductive sheet, and the fourth conductive sheet each has a thickness that is less than about 0.005 inches.

7. The apparatus of claim 1, wherein the first plurality of conductive sheets includes a first insulating layer disposed between the first conductive sheet and the second conductive sheet, and wherein the second plurality of conductive sheets includes a second insulating layer disposed between the third conductive sheet and the fourth conductive sheet.

8. The apparatus of claim 7, wherein the first insulating layer comprises a first polyimide film, and wherein the second insulating layer comprises a second polyimide film.

9. The apparatus of claim 1, wherein the first plurality of connectors is coupled to a first circuit board, and wherein the second plurality of connectors is coupled to a second circuit board.

10. The apparatus of claim 9, wherein a first end of the first plurality of conductive sheets is coupled to the first circuit board, wherein a second end of the first plurality of conductive sheets is coupled to the second circuit board, wherein a first end of the second plurality of conductive sheets is coupled to the first circuit board, and wherein a second end of the second plurality of conductive sheets is coupled to the second circuit board such that the first plurality of conductive sheets and the second plurality of conductive sheets are coupled to the first circuit board and the second circuit board in parallel.

11. The apparatus of claim 1, wherein the first plurality of connectors is configured to be connected to a power source, and wherein the second plurality of connectors is configured to be connected to an antenna.

12. The apparatus of claim 1, wherein the first plurality of connectors and the second plurality of connectors each comprises a material selected from the group consisting of gold, nickel, and copper.

13. A system for transferring power, the system comprising:

a first plurality of connectors;

a second plurality of connectors;

a first plurality of conductive sheets configured to electrically couple the first plurality of connectors with the second plurality of connectors, the first plurality of conductive sheets including a first conductive sheet and a second conductive sheet, wherein the first conductive sheet is configured to conduct a first current in a first direction, and wherein the second conductive sheet is configured to provide a return path for the first current in a second direction;

a second plurality of conductive sheets configured to electrically couple the first plurality of connectors with the second plurality of connectors, wherein the first plurality of conductive sheets and the second plurality of conductive sheets are independently flexible and independently encapsulated such that they are configured to provide independently flexible and encapsulated parallel conductive paths between the first and second plurality of connectors, the second plurality of conductive sheets including a third conductive sheet and a fourth conductive sheet, wherein the third conductive sheet is configured to conduct a second current in the first direction, and wherein the fourth conductive sheet is configured to provide a return path for the second current in the second direction;

a power source coupled to the first plurality of connectors, wherein the power source is configured to generate a power signal and is further configured to provide the power signal to the first plurality of connectors; and an antenna coupled to the second plurality of connectors, wherein the antenna is configured to receive the power signal from the second plurality of connectors.

14. The system of claim 13, wherein the first plurality of conductive sheets and the second plurality of conductive sheets are configured to provide parallel conductive paths between the power source and the antenna.

15. The system of claim 13 further comprising:

a third plurality of conductive sheets configured to electrically couple the first plurality of connectors with the second plurality of connectors, the third plurality of conductive sheets including a fifth conductive sheet and a sixth conductive sheet, wherein the fifth conductive sheet is configured to conduct a third current in the first direction, and wherein the sixth conductive sheet is configured to provide a return path for the third current in the second direction; and a fourth plurality of conductive sheets configured to electrically couple the first plurality of connectors with the second plurality of connectors, the fourth plurality of conductive sheets including a seventh conductive sheet and an eighth conductive sheet, wherein the seventh conductive sheet is configured to conduct a fourth current in the first direction, and wherein the eighth conductive sheet is configured to provide a return path for the fourth current in the second direction.

16. The system of claim 13, wherein the power signal has a voltage amplitude of about 12 V and a current amplitude of about 60 A.

17. The system of claim 13, wherein the power signal generated by the power source has a frequency of about 100 kHz.

18. A method for manufacturing a power bus, the method comprising:

providing a first plurality of conductive sheets, the first plurality of conductive sheets including a first conductive sheet and a second conductive sheet;

forming a first insulating layer between the first conductive sheet and the second conductive sheet;

providing a second plurality of conductive sheets, the second plurality of conductive sheets including a third conductive sheet and a fourth conductive sheet;

forming a second insulating layer between the third conductive sheet and the fourth conductive sheet;

coupling a first end of the first plurality of conductive sheets and a first end of the second plurality of conductive sheets with a first plurality of connectors; and coupling a second end of the first plurality of conductive sheets and a second end of the second plurality of conductive sheets with a second plurality of connectors, wherein the first plurality of conductive sheets and the second plurality of conductive sheets are coupled in parallel, and wherein the first plurality of conductive sheets and the second plurality of conductive sheets are independently flexible and independently encapsulated such that they are configured to provide independently flexible and encapsulated parallel conductive paths between the first and second plurality of connectors.

19. The method of claim 18 further comprising:

providing a third plurality of conductive sheets, the third plurality of conductive sheets including a fifth conductive sheet and a sixth conductive sheet;

forming a third insulating layer between the fifth conductive sheet and the sixth conductive sheet;

providing a fourth plurality of conductive sheets, the fourth plurality of conductive sheets including a seventh conductive sheet and an eighth conductive sheet;

forming a fourth insulating layer between the seventh conductive sheet and the eighth conductive sheet;

coupling a first end of the third plurality of conductive sheets and a first end of the fourth plurality of conductive sheets with the first plurality of connectors; and coupling a second end of the third plurality of conductive sheets and a second end of the fourth plurality of conductive sheets with the second plurality of connectors, wherein the first plurality of conductive sheets, the second plurality of conductive sheets, the third plurality of conductive sheets, and the fourth plurality of conductive sheets are coupled in parallel.

20. The method of claim 18 further comprising:

forming a first cover layer on a first surface of the first plurality of conductive sheets;

forming a second cover layer on a second surface of the first plurality of conductive sheets;

forming a third cover layer on a first surface of the second plurality of conductive sheets; and forming a fourth cover layer on a second surface of the second plurality of conductive sheets.

* * * * *